US005240439A

United States Patent [19]

Egenolf

[11] Patent Number: 5,240,439

[45] Date of Patent: Aug. 31, 1993

[54] ELECTRICAL CONTACT

[75] Inventor: Bernhard Egenolf, Dreieich-Sprendlingen, Fed. Rep. of Germany

[73] Assignee: AMP Incorporated, Harrisburg, Pa.

[21] Appl. No.: 887,639

[22] Filed: May 22, 1992

[30] Foreign Application Priority Data

Jun. 3, 1991 [DE] Fed. Rep. of Germany ... 9106775[U]

[51] Int. Cl.[5] ..... H01R 13/426

[52] U.S. Cl. ..... 439/745; 439/839

[58] Field of Search ..... 439/745, 748, 839, 847

[56] References Cited

U.S. PATENT DOCUMENTS

| | | | |
|---|---|---|---|
| 3,665,378 | 5/1972 | Hammell et al. | 439/748 |
| 3,697,934 | 10/1972 | Merry | 439/748 |
| 3,748,633 | 7/1973 | Lundergan | 439/748 |
| 4,834,681 | 5/1989 | Chaillot | 439/856 |
| 5,035,658 | 7/1991 | Berg | 439/748 |

FOREIGN PATENT DOCUMENTS

0196367A1 4/1985 European Pat. Off. .

OTHER PUBLICATIONS

English Translation of French Patent Application No. 2,627,020.

*Primary Examiner*—Gary F. Paumen

*Attorney, Agent, or Firm*—Bruce J. Wolstoncroft

[57] ABSTRACT

An electrical contact adapted for plugging connection is provided with locking lances projecting therefrom in obliquely outward direction and engaging a locking shoulder of a contact receiving chamber when said contact is inserted into said contact receiving chamber. The locking lances are disposed on the mating end of the electrical contact at the mating end of an outer back-up spring disposed on the contact.

7 Claims, 5 Drawing Sheets

ELECTRICAL CONTACT

BACKGROUND OF THE INVENTION

1. Field of the Invention

The invention relates to an electrical contact having at least one locking lance projecting from the contact body for locking the contact in a contact receiving chamber of an electrical connector.

2. Description of the Prior Art

Known contacts of this type, both with and without outer back-up spring, have locking lances disposed on the contact or on the outer back-up spring, respectively, approximately in the longitudinal center of the contact or even in the vicinity of the wire terminating portion thereof. The electrical wires extending away from the wire terminating portions of contacts of a connector often are subjected to transverse forces during operation. These forces have the effect that a contact concerned performs pivotal motions transversely of its longitudinal direction, the pivotal axis of this pivotal motion being located in the region of the locking lances. When the locking lances are disposed in conventional manner in the longitudinal center or even at the wire-terminating-side end of the contact, such transverse forces acting on the terminated wire lead to a correspondingly great pivotal motion of the mating-side longitudinal end of the contact. These strong pivotal motions cause an undesired mechanical load of the connection between receiving contact and tab contact.

Furthermore, such strong pivotal motions may have the effect that the contact spring arms and the tab contact inserted therebetween are shifted with respect to each other in the width direction of the contact spring arms to such an extent that the remaining width overlapping portion between the contact spring arms and the tab contact inserted therebetween is not sufficient any more for ensuring the planned maximum current in the contact transition between the contact spring arms and the tab contact placed therebetween. With conventional solutions this can be countered only by producing receiving contact, tab contact, connector housings and the contact receiving chambers thereof with close tolerances. However, this results in an increase in manufacturing expenditure and manufacturing costs and in an aggravation of the operation of inserting the contacts into the contact receiving chambers.

SUMMARY OF THE INVENTION

It is the object of the invention to overcome these problems with as low costs as possible.

With the contacts of the type indicated at the outset, this object is met according to the invention in that the contact body or the outer back-up spring body, respectively, extends as far as into the region of the mating end of the contact receiving portion or the contact spring arms, respectively, and the locking lance is arranged in the region of the mating end of the outer back-up spring body, respectively.

These measures have the effect that the rotational axis for pivotal motions due to transverse forces acting on a crimpingly terminated wire is located at the mating-side end of the contact. Thus, the mating end of the contact remains substantially free from pivotal motions also in case of transverse forces acting on a terminated wire. The mechanical loads mentioned are therefore largely avoided. Furthermore, it is possible to allow more tolerance play between the contact spring arms and the tab inserted therebetween.

In case of contacts formed with locking lances at conventional locations and, furthermore, frequently with relatively long locking lances, there is the problem that wires often become entangled behind the locking lances during the manufacture of cable harnesses. This is a problem especially with the fully automatic production of harnesses and application of contacts to the wires of the harnesses.

According to the invention, this problem is avoided in that the locking lances are not only comparatively short, but that those sidewalls of the contact body or of the outer back-up spring body, respectively, which are adjacent the sidewall provided with a locking lance are each provided with a convex bulge in the longitudinal extension portion of the locking lance, said bulge being configured such that the space between the bulge and the locking lance prevents the tangling of an electrical wire therebetween. When wires of different thickness are connected to the contacts of a multi-pole connector, the space between the bulge and the locking lance is selected to be narrower than the thinnest wire terminated to the contacts of this connector.

The bulges can be made during stamping with very accurate dimensions. This allows good and accurate positioning of the portion of the contact or outer back-up spring, respectively, provided with the bulges. The bulges can thus be used for supporting the contact in the contact receiving chamber. Due to the fact that the bulges are located in the region of the contact zone between contact and tab inserted therein, the contact zone remains at rest even in case of tumbling motions of the contact, e.g. as a result of transverse forces acting on the terminated wire. It is even possible to leave a space free between contact or outer back-up spring, respectively, and contact chamber outside of the portion of the bulges. This facilitates insertion of the contact into the contact receiving chamber.

The locking lance may extend across the entire width of the sidewall of the outer back-up spring body belonging to said lance. The risk that a wire becomes entangled in the contact or the outer-back up spring, respectively, in the region of the locking lance then is particularly low.

DETAILED DESCRIPTION OF THE PREFERRED EMBODIMENT

Figure 1:
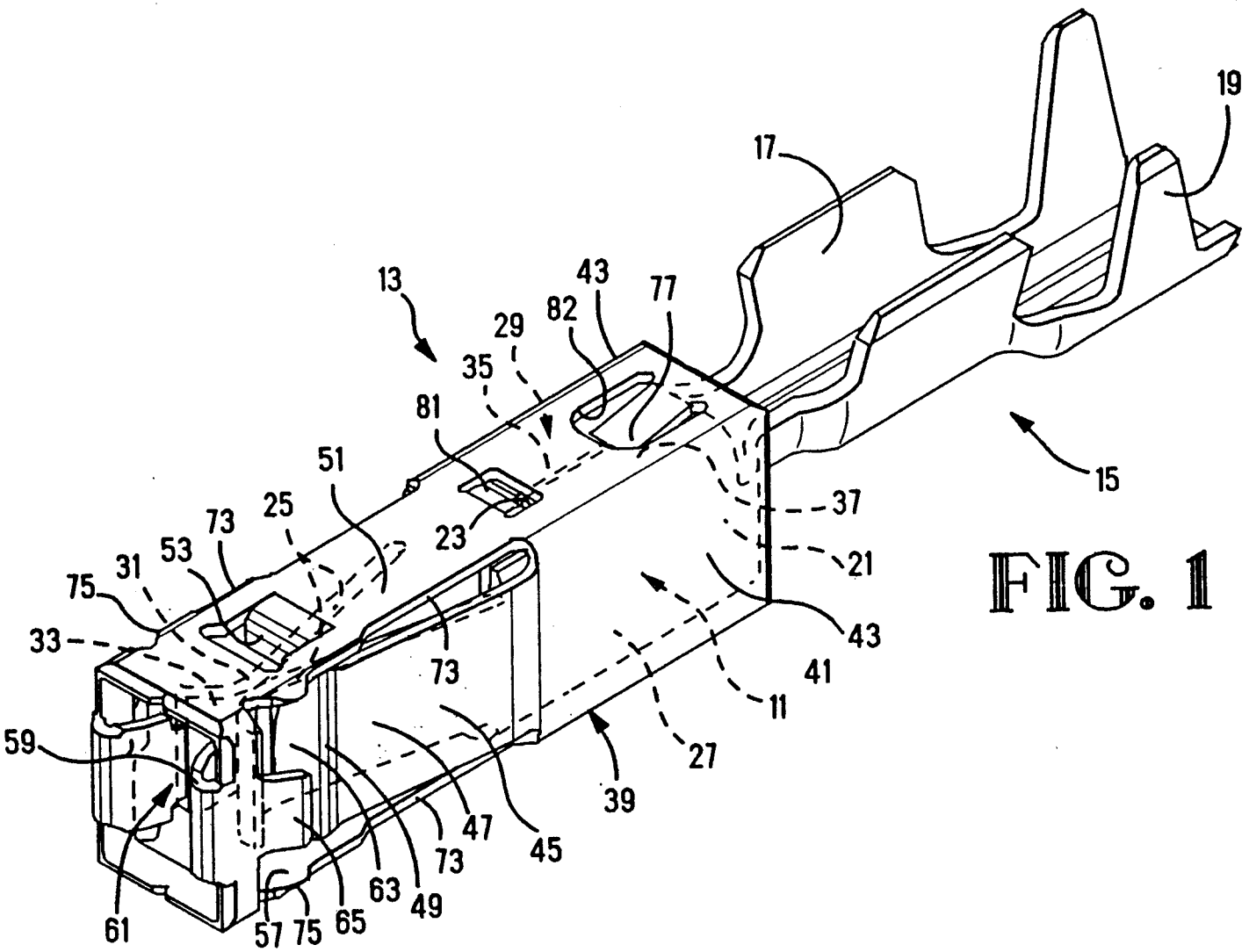
FIG. 1 shows a perspective side view of a contact according to the invention.

FIG. 1 shows a contact 11 adapted for plugging connection, which is constructed in the form of a receptacle contact and is provided with an outer back-up spring 13. Those portions of contact 11 that are hidden by the outer back-up spring 13 are shown in broken lines.

Contact 11 comprises a wire terminating portion 15 having in known manner a conductor crimping zone 17 and an insulating crimping zone 19. Conductor crimping zone 17 is crimped onto a stripped electrical conductor of an electrical wire. Insulation crimping zone 19 is crimped onto the remaining insulating jacket of the wire.

Contact 11 comprises a contact body 21 following the wire terminating portion 15 and, in the embodiment shown, being provided in the form of a closed box of substantially rectangular cross-section. A pair of contact spring arms 25 projects from the mating longitudinal end 23 of contact body 21. Each of the two contact spring arms 25 constitutes an integral continuation of one of two opposing sidewalls 27, 29 of the contact body 21.

The contact 11 shown in the figures is a single flat spring contact. However, it could also be provided in the form of a double flat spring contact, in which two contact arms each would project from each of the two sidewalls 27, 29 of contact body 21.

The two contact spring arms 25 extend towards each other in converging manner until they contact each other in a line of contact 31. On the side of the contact line 31 located on the mating side, the free ends of contact spring arms 25 diverge so as to form an insertion funnel 33. The insertion funnel 33 facilitates insertion of a flat contact, which often is also referred to as tab contact.

Due to the fact that contact 11 is stamped and formed from one single piece of sheet metal, the box-shaped contact body 21 thereof has an abutment seam 35 extending in the longitudinal direction thereof. In the embodiment shown in FIG. 1, the abutment seam is located in the, with respect to FIG. 1, upper wall of contact body 21, which will be referred to as top part 37 hereinafter. The outer back-up spring 13 comprises an outer back-up spring body 39. The outer back-up spring 13 extends from the wire-terminating-side end of contact body 21 beyond the free ends of the insertion funnel 33 of the contact spring arms 25. Outer back-up spring body 39 comprises a box-portion 41 of substantially rectangular, closed box-shape, which is seated on the contact body 21 and encloses the same. Each outer back-up spring arm 45 is cut free from opposing sidewalls 43 of the outer back-up spring body 39. The two outer back-up spring arms 45 extend from box portion 41 and converge at a first angle of convergence. Starting from a bending line 47 in the vicinity of the free ends 49 thereof, the two outer back-up spring arms 45 converge at a greater angle of convergence.

From top part 51 of the outer back-up spring body 39, which is shown on top in FIG. 1, a spacing lug 53 is cut free and is bent with its free end extending into the interior of the outer back-up spring body 39 at right angles with respect to top part 51. As can be seen best from FIG. 4, the outer back-up spring arms 45, in the longitudinal direction of the bent portion of said spacing lug 53, are of greater width than the contact spring arms 25, such that the outer back-up spring arms 45 have extensions 55 which extend beyond the longitudinal edges of the contact spring arms 25. The free end of the spacing lug 53 is spaced from spring arms 25.

Figure 4:
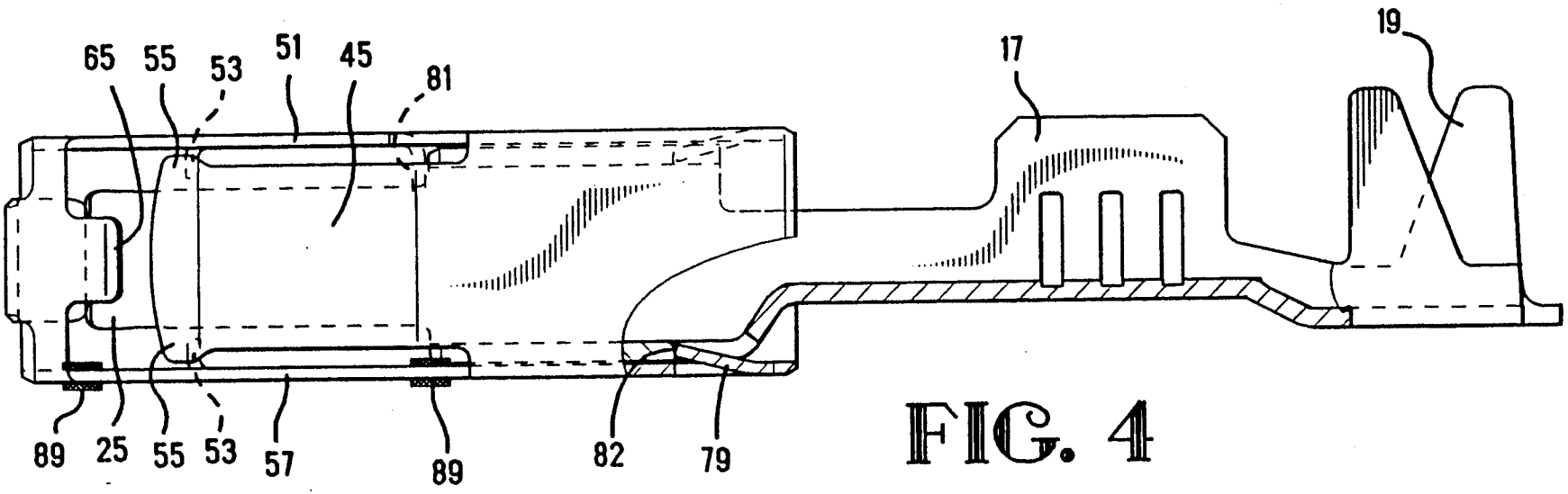
FIG. 4 shows a longitudinal side view of this contact.

As can be seen best from FIG. 4, a spacing lug 53 does not only extend from the top part 51 of the outer back-up spring body 39, but a spacing lug 53 extends also from the bottom part 57 thereof between the lower projecting extensions 55 of the two outer back-up spring arms 45.

The spacing lugs 53 are positioned in the longitudinal direction of extension of the outer back-up spring 13 such that they come to lie between the outer back-up spring arms 45 in the region of bending line 47.

Figure 2:
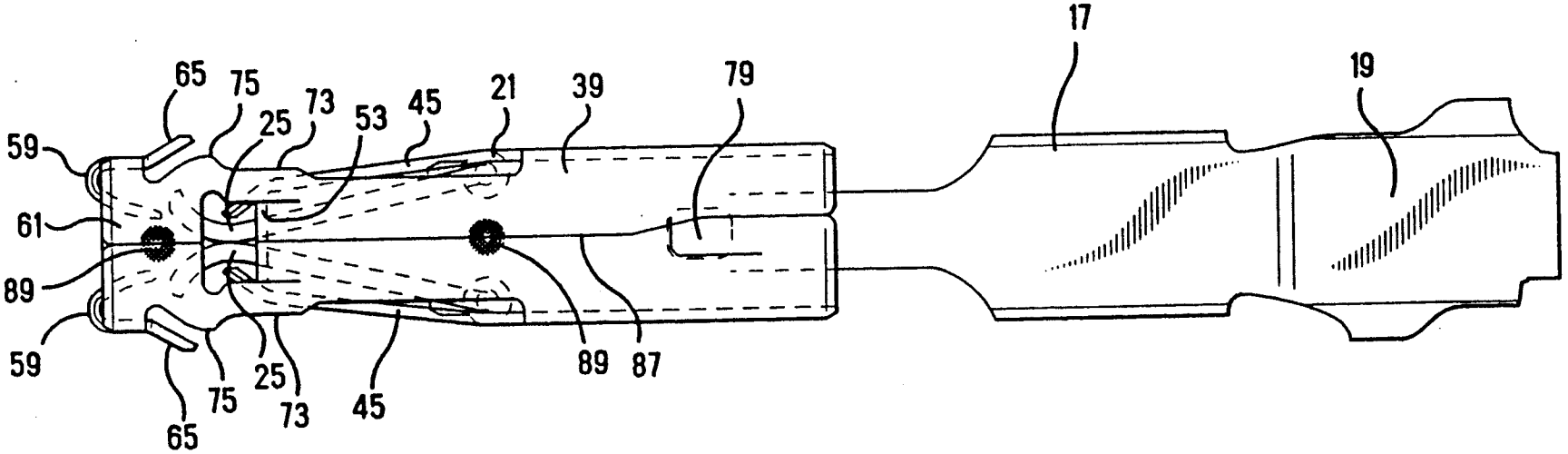
FIG. 2 shows a bottom plan view of a contact substantially identical with that of FIG. 1.
Figure 3B:
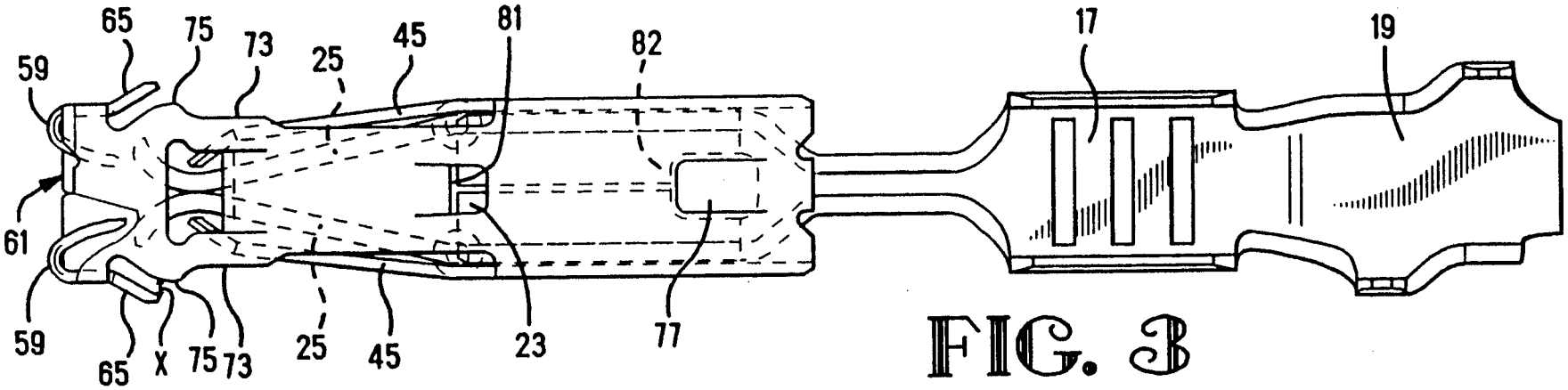
FIG. 3 shows a top plan view of said contact.

As can be seen best in FIGS. 2 and 3, the free ends of the outer back-up spring arms 45 are located substantially at the level of the contact line 31 of the contact spring arms 25, but are held spaced from the contact spring arms 25 by said spacing lugs 53.

When a tab contact (not shown in the drawings) is inserted between the opposing contact spring arms 25, this causes the two contact spring arms 25 to be spread apart, which at first is countered only by the spring force of the two contact spring arms 25. During further insertion of the tab contact between the contact spring arms 25, the contact spring arms 25 abut the free ends cf the outer back-up spring arms 45. Upon still further insertion, not only the contact spring arms 25 but also the outer back-up spring arms 45 are caused to spread apart. Starting with this moment of time, a contact force corresponding to the sum of these two spring forces is produced between the receptacle contact 11 and the tab contact.

The width of the spacing lugs 53 in the spreading direction of the outer back-up spring arms 45 is selected such that the spreading gap between the two contact spring arms 25 in contact line 31 is slightly smaller than the thickness of the tab contact. The effect achieved by such dimensioning is that, during the largest part of the insertion operation, only the relatively low spring force of the contact spring arms 25 becomes effective, and the sum of the spring forces of the contact spring arms 25 and of the outer back-up spring arms 45 becomes effective only in the end phase of the insertion operation.

Projecting from the mating ends of the sidewalls 43 of the outer back-up spring body 39 are extended portions 59 bent into the mating end of the outer back-up spring body 39 with such convergence of the free ends thereof towards each other that an auxiliary funnel 61 is formed. Auxiliary funnel 61 facilitates insertion of the tab contact into the insertion funnel 33 of the contact spring arms 25.

Figure 5:
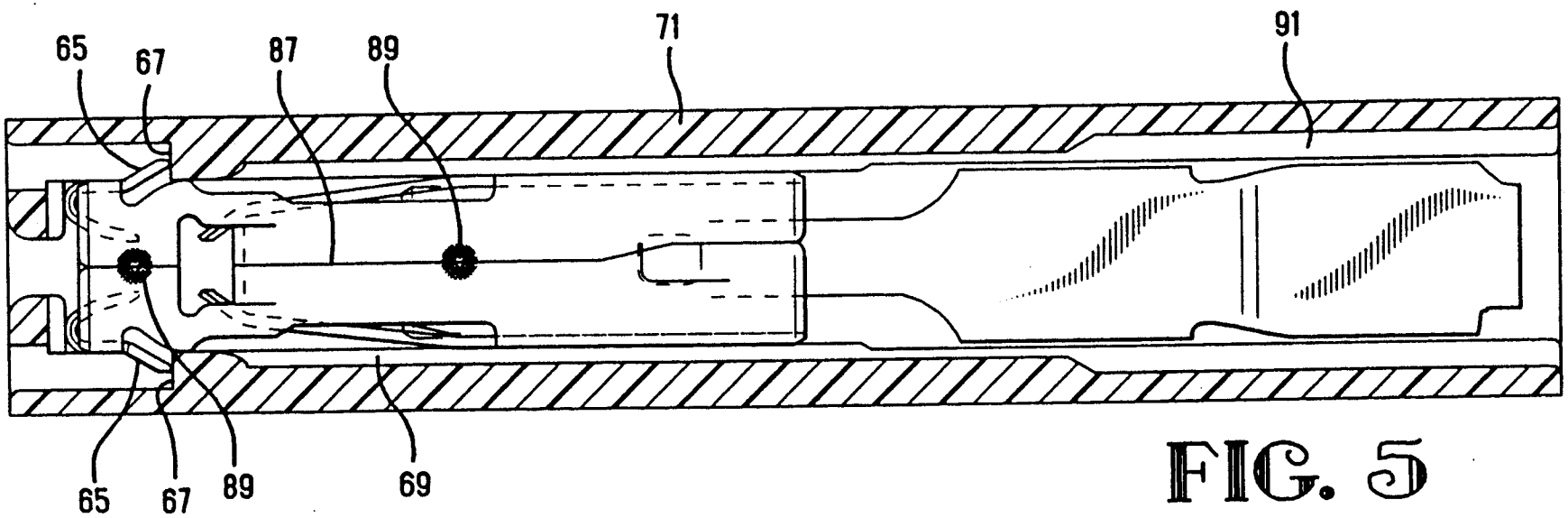
FIG. 5 shows a sectional view of an insulating housing having receiving chambers, illustrating one such chamber having a contact according to the invention inserted therein.

Extending from the mating ends of the cut-free openings 63, produced in conjunction with the cutting-free of the outer back-up spring arms 45, are locking lances 65 which project obliquely outwardly and have their free ends directed towards the wire terminating portion 15. These lances cooperate with locking shoulders 67 formed at corresponding locations of associated contact receiving chambers 69 in a connector housing 71 of insulating material, as shown in FIG. 5.

The locking lances 65 preferably are of short length, preferably in the range from about 10 to 20 percent of the length of the contact spring arms 25.

Locking lances for locking electrical contacts in the contact receiving chambers of connector housings are usually provided in the region of the contact body 21, i.e. in the vicinity of the wire terminating portion 15 and thus approximately in the longitudinal center of the contact as a whole, or even at the wire-terminating-side longitudinal end of the contact. The electrical wires extending from the wire terminating portions of contacts of a connector are often subjected to transverse forces during operation. These forces causes the contact to pivot transversely of its longitudinal direction, with the pivot axis of this pivotal motion being located in the region of the locking lances. When the locking lances are disposed in conventional manner in the longitudinal center or even at the wire-terminating-side end of the contact, such transverse forces acting on the terminated wire lead to a correspondingly high pivotal motion of the longitudinal end of the contact on the mating side. These strong pivotal motions cause an undesired mechanical load of the connection between receptacle contact and tab contact.

This problem is overcome by the arrangement of the locking lances 65 on the mating end of the outer back-up spring body 39 according to the invention. Due to the fact that the rotational axis for pivotal motions as a result of transverse forces applied to a crimpingly terminated wire is now located at the mating end of the outer back-up spring body 39 and thus of contact 11, the contact portion between contact spring arms 25 and the tab inserted therebetween remains substantially unaffected by such pivotal motions. The mechanical loads mentioned are thus largely avoided. Furthermore, it is possible to allow more tolerance play between the contact spring arms 25 and the tab inserted therebetween. Due to the fact that the contact portion between the contact spring arms 25 and the tab inserted therebetween must be designed for transmitting a specific current intensity that is dependent on the particular application, the contact spring arms 25 and the tab must overlap each other by a minimum width in all instances of movement for being able to transfer this current intensity across the contact location. Since, when the locking lances are positioned according to the invention, only a slight pivotal motion can occur when transverse forces act on the terminated wire, the risk is low that the contact-establishing overlapping portion between the contact spring arms 25 and the tab changes significantly due to the pivotal forces acting on the wire terminating portion 15. This allows more tolerance play between the contact spring arms 25 and the tab than in case of stronger pivotal motions as they may occur when the locking lances are positioned in the center or even at the wire terminating end of the contact.

As is clearly gatherable from FIGS. 1 to 3, the longitudinal edges 73 both of top part 51 and of bottom part 57 of the outer back-up spring body 39 are each provided with an outwardly directed convex bulge 75 in the region of their mating ends. The convex bulges are of such a shape that the distance X between their outer contour and the respectively adjacent locking lance 65, as shown in FIG. 3, is smaller than the thickness of the thinnest wire to be terminated to contact 11 or another contact of the same connector housing. This prevents tangling of wires in the locking lances 65. This is a serious problem with contacts having conventional locking lances which often are not only considerably longer than the present locking lances 65 but are not provided, either, with a tangling projection for wires in the form of the bulge 75. Such tangling occurs often and is a nuisance in making and handling cable harnesses the lines of which are terminated to contacts like the contact concerned herein, especially when the production of such harnesses and the termination of contacts to the wires thereof is made by means of automatic machines.

The bulges 75 have a further function. They render possible exact guiding of the contact 11 provided with the outer back-up spring 13 in the contact receiving chamber 69. The bulges 75 can be defined very well in the stamping operation as regards their dimensions. The contact provided with the outer back-up spring 13 thus can be positioned very well within the contact receiving chamber 69.

The bulges 75 support in the contact zone of contact 11 such that, in case of a tumbling motion of the contact 11 in the contact receiving chamber 69, e.g. because of transverse forces acting on the wire terminated thereto, the contact zone remains at rest. Other portions of the contact 11, in particular the wire terminating portion 15, are free to tumble. Therefore, a space 91 can be left free in the contact receiving chamber 69 outside of the portions cooperating with the bulges 75. This facilitates introduction of the contact 11 provided with the outer back-up spring 13.

The outer back-up spring 13 is adapted to be snapped onto contact 11. To this end, a locking lance 77 and 79 is provided both in the top part 51 and in the bottom part 57, respectively, and a locking stop 81 is provided in top part 51 of the outer back-up spring body 39. The locking lances 77, 79 and the locking stop 81 are each struck out from the top part 51 and the bottom part 57, respectively, and are bent into the interior of the outer back-up spring body 39. While locking stop 81 extends vertically into the interior of outer back-up spring body 39, locking lances 77 and 79 project obliquely into the interior of outer back-up spring body 39, with the free ends of the locking lances 77, 79 being directed towards the mating end of the outer back-up spring body 39.

In the embodiment shown in FIG. 1, the locking lances 77, 79 are cut free from the top part 51 and the bottom part 57, respectively, and then are bent into the box portion 41 of the outer back-up spring body 39. FIGS. 2 to 5 show an embodiment that is modified with respect to the locking lances 77, 79. In this embodiment, the locking lances 77 and 79 are each formed in that a corresponding portion of the top part 51 and the bottom part 57, respectively, has been sheared through and pushed inwardly into the interior of the box portion 41.

The locking stop 81 can be formed in the same manner.

A further possibility consists in forming the locking projections by pushing the corresponding portion of the outer back-up spring inwardly in non-shearing manner, i.e. by forming a recess by inwardly directed pressure.

The resiling effect desired for the locking projections 77 and 79 is rendered possible in this embodiment by the resilience of the part of the outer back-up spring surrounding the respective locking projection.

When the outer back-up spring body 39 is snapped onto contact the locking stop 81 is located opposite a transverse edge at the mating end of contact body 21, said transverse edge being constituted by the longitudinal end 23 on the mating side. The free ends of the locking lances 77 and 79 are each located opposite a transverse edge 82 on the wire terminating side, with the latter edge being formed by a cutout in the wire-terminating-side end of the top part 37 and the bottom part 83 of the contact body 21, respectively.

The wire-terminating-side transverse edges 82 cooperating with the free ends of the locking lances 77 and 79 may also be constituted by the wire-terminating-side ends of the top part 37 and the bottom part 83 of the contact body 21, respectively. The angle between the locking lances 77, 79 and the top part 51 and the bottom part 57, respectively, of the outer back-up spring body 39 is selected such that the free ends of the locking lances 77, 79, in the unstressed condition, are located at the level of the transverse edges 82 on the wire terminating side.

For mounting to contact 11, the outer back-up spring is slid onto the contact 11 from the mating free ends of the contact spring arms 25. When, in doing so, the locking lances 77 hit the mating longitudinal ends 23 of contact body 21, these lances are stressed in a resilient manner and slide across top part 37 and bottom part 83 of contact body 21, until the free ends thereof have passed across the transverse edges 82 on the wire terminating side and the locking lances 77 and 79 are allowed to return into their unstressed position. In doing so, locking stop 81 cooperates with the mating longitudinal end 23 of the top part 37 of the contact body 21 in such a manner that a further sliding motion of the outer back-up spring 13 in the direction towards wire terminating portion 15 is prevented. A backward sliding motion of the outer back-up spring 13 in the direction towards the mating end of the contact 11 is prevented by the cooperation between the locking lances 77, 79 and the transverse edges 82. The outer back-up spring 13 is in this position snapped onto contact body 21 and is locked there.

An operation such as moving locking lances disposed on the outer back-up spring into associated locking recesses on the contact, or bending of locking lances of the outer back-up spring about web portions of the contact is not necessary any more with the design of contact and outer back-up spring according to the invention. All operations on contact 11 and outer back-up spring 13, which serve for the locking process, can thus be carried out while contact 11 and outer back-up spring 13 are still separated from each other, preferably even on the flat stamped blanks before these are bent into the shape of contact 11 and outer back-up spring 13, respectively.

The outer back-up spring 13 has been created by bending a stamped sheet metal part in the form of a box. An abutment joint 87 formed during such bending is closed by welding. Preferably, a laser spot welding process is used therefor. Two welding spots 89 are shown in FIGS. 2 and 4.

The outer back-up spring body 39 encloses the contact spring arms 25 across the entire length thereof, to provide good protection of the contact spring arms 25 against damage thereof.

The rounded corners and edges, for instance in the root portion of auxiliary funnel 61, render possible easy insertion of the contact 11 provided with outer back-up spring 13 into a contact receiving chamber 69 of connector housing 71.

Due to the fact that the wire-terminating-side end of the outer back-up spring body 39 projects at the four longitudinal sides thereof beyond the contact body 21, there is the possibility that secondary locking means, formed on or in connector housing 71 and engaging only in the closed condition behind an edge or a shoulder of the contact or the outer back-up spring, can engage in arbitrary manner on the wire-terminating-side end of each of the four longitudinal sides of the outer back-up spring body 39.

I claim:

1. An electrical contact adapted for plugging connection, comprising a contact body having a contact receiving portion extending therefrom for pluggably receiving a complementary contact, said electrical contact having at least one locking lance projecting therefrom in an obliquely outward direction and engaging a correspondingly positioned locking shoulder of a contact receiving chamber of a connector housing when said contact is inserted into said contact receiving chamber, the contact thereby being locked in the contact receiving chamber, characterized in that the contact receiving portion has a mating end and the at least one locking lance is arranged in the region of the mating end, the contact receiving portion comprising at least one pair of contact spring arms and cooperating with each other for pluggably receiving a tab contact, the contact being provided with a separate outer back-up spring having an outer back-up spring body from which at least one pair of outer back-up spring arms extends, each of said arms extending along, and outside of, an associated contactd spring arm, the at least one locking lance projecting from the outer back-up spring body.

2. A contact according to claim 1, characterized in that two of said locking lances each project from opposite sides, respectively, of the outer back-up spring body.

3. A contact according to claim 2, characterized in that sidewalls of the outer back-up spring body are each provided with a convex bulge near the respective locking lance, the respective bulges and locking lances being spaced to prevent the tangling of an electrical wire therebetween.

4. A contact according to claim 1, characterized in that the locking lance extends substazntially across the entire width of the sidewall of the outer back-up spring body from which said lance projects.

5. A contact according to claim 1, characterized in that the locking lance length is short as compared to the length of the contact receiving portion or of the contact spring arms, respectively.

6. A contact according to claim 6, characterized in that the locking lance length is in the range of approximately 10 to 20 percent of the length of the contact receiving portion or of the contact spring arms, respectively.

7. A contact according to claim 3, characterized in that the bulges are supported on opposite inside walls, respectively, of the contact receiving chamber and in that a free space is left between part of the remaining portions of the contact and the respective opposite inside wall portions of the contact receiving chamber.

* * * * *